US006384788B2

(12) United States Patent
Pretorius et al.

(10) Patent No.: US 6,384,788 B2
(45) Date of Patent: May 7, 2002

(54) ANTENNA WITH A STRIPLINE FEED

(75) Inventors: Johannes Arnoldus Pretorius; William Ian George; Marius Du Plessis, all of Cape Town (ZA)

(73) Assignee: Omnipless (Proprietary) Limited, Hout Bay (ZA)

( * ) Notice: Subject to any disclaimer, the term of this patent is extended or adjusted under 35 U.S.C. 154(b) by 0 days.

(21) Appl. No.: 09/827,036

(22) Filed: Apr. 5, 2001

(30) Foreign Application Priority Data

Apr. 7, 2000 (ZA) ..... 00/1767

(51) Int. Cl.[7] ..... H01Q 1/38
(52) U.S. Cl. ..... 343/700 MS; 343/846
(58) Field of Search ..... 343/700 MS, 846, 343/848, 829; 29/600

(56) References Cited

U.S. PATENT DOCUMENTS 4,816,835 A * 3/1989 Abiko et al. ..... 343/700 MS
4,965,605 A * 10/1990 Chang et al. ..... 343/700 MS
5,408,241 A * 4/1995 Shattuck, Jr. et al. . 343/700 MS
5,465,100 A * 11/1995 Remondiere et al. ..... 343/769

* cited by examiner

*Primary Examiner*—Tan Ho
(74) *Attorney, Agent, or Firm*—Wood, Herron & Evans, L.L.P.

(57) ABSTRACT

An antenna comprises a metal sheet (12), an array of radiator elements (14) on the upper side of the metal sheet, and a stripline feed (20) for the radiator elements on the lower side of the metal sheet. The metal sheet is shaped to have first portions (12.1) which are at a low level, a second portion (12.2) which is at a high level, and intermediate portions (12.3) which join the second portion to the first portions, thereby forming a channel in the underside of the metal sheet, the channel being between a pair of the radiator elements. The stripline feed is in the channel, at a level which is higher than that of the upwardly facing surfaces of the first portions. The first portions form a ground plane for the radiator elements, and the second portion forms an upper ground plane for the stripline feed. The lower ground plane of the stripline feed is formed by a sheet of metal foil (24) which extends across the channel.

12 Claims, 1 Drawing Sheet

FIG 2

ANTENNA WITH A STRIPLINE FEED

BACKGROUND TO THE INVENTION

This invention relates to an antenna. More particularly it relates to an antenna with a stripline feed.

Antennas generally have one or more radiator elements which are separated from a conductive ground plane by means of one or more layers of a dielectric substrate. Where the antenna is provided with a stripline feed for the radiator elements, the ground-plane serves as an upper ground plane for the stripline, there being a further conductive ground plane below the level of the upper ground plane. The stripline is between the upper and lower ground planes and is separated therefrom by layers of dielectric substrate which are at a level below that of the upper ground plane. In comparison with a microstrip feed, a stripline feed offers the advantage of no feed radiation and lower loss, but at the cost of higher complexity of the structure.

The most common method of making such antennas involves the use of photolithographic or etching techniques on thin copper sheets laminated on microwave substrate materials. Shorting pins which extend through holes in the upper ground plane are used to connect the feed to the radiator elements. The need in this construction for substrate layers below the level of the upper ground plane adds to the overall thickness of the antenna, and there are often limitations on the maximum thickness that is commercially acceptable.

It is an object of the invention to provide an antenna construction in which more efficient use is made of the available volume, and which makes use of low cost and, in the case of the dielectric material, low loss materials, which can be die-cut with sufficient accuracy to enable repeatable high volume assembly.

SUMMARY OF THE INVENTION

According to one aspect of the invention there is provided an array antenna which comprises:

an array of radiator elements;

a stripline feed for the radiator elements;

a metal component which includes a first portion having an upwardly facing surface at a first level, and a second portion having a downwardly facing surface at a second level, the radiator elements being above the first portion, the second level being higher than the first level, and the stripline feed being at a third level between the first and second levels.

The metal component may be in the form of a metal sheet which is shaped to form said first portion, said second portion, and an intermediate portion which extends from the first portion to the second portion.

The metal sheet may be of an un-annealed aluminium.

The metal sheet may be formed by pressing, in a deep drawing tool.

There may, in respect of each of the radiator elements, be an opening in the intermediate portion, the stripline feed having an extension which passes through the opening to the respective radiator element.

Said second portion may be between a pair of said radiator elements, there being a said first portion and a said intermediate portion on each opposite side of the second portion, thereby to form a channel in the underside of the metal sheet, the stripline feed being in the channel.

The antenna may further comprise a sheet of conductive foil which extends across the channel on the underside of the metal sheet, said second portion forming an upper ground plane for the stripline feed and said sheet of conductive foil forming a lower ground plane for the stripline feed.

Said sheet of conductive foil may have opposite edge portions which overlie and are adhesively secured to the underside of the respective first portions.

Each radiator element may be separated from said first portion by a spacer element which is of an extruded plastics material having a cellular configuration in cross-section.

The stripline feed may be held between spacer strips which are of an extruded plastics material having a cellular configuration in cross-section.

According to another aspect of the invention there is provided an array antenna which comprises:

a metal sheet having an upper side and a lower side;

an array of radiator elements on the upper side of the metal sheet, each radiator element being separated from the metal sheet by a spacer element of dielectric material; and a stripline feed for the radiator elements, the stripline feed being on the lower side of the metal sheet;

the metal sheet being shaped to have a first portion which is at a low level, a second portion which is at a high level, and an intermediate portion which extends from the first portion to the second portion; and the arrangement of the radiator elements and the stripline feed in relation to the metal sheet being such that said first portion forms a ground plane for the radiator elements, and said second portion forms an upper ground plane for the stripline feed.

The invention will now be described in more detail, by way of example, with reference to the accompanying diagrammatic drawings.

DETAILED DESCRIPTION OF PREFERRED EMBODIMENTS

Figure 1:
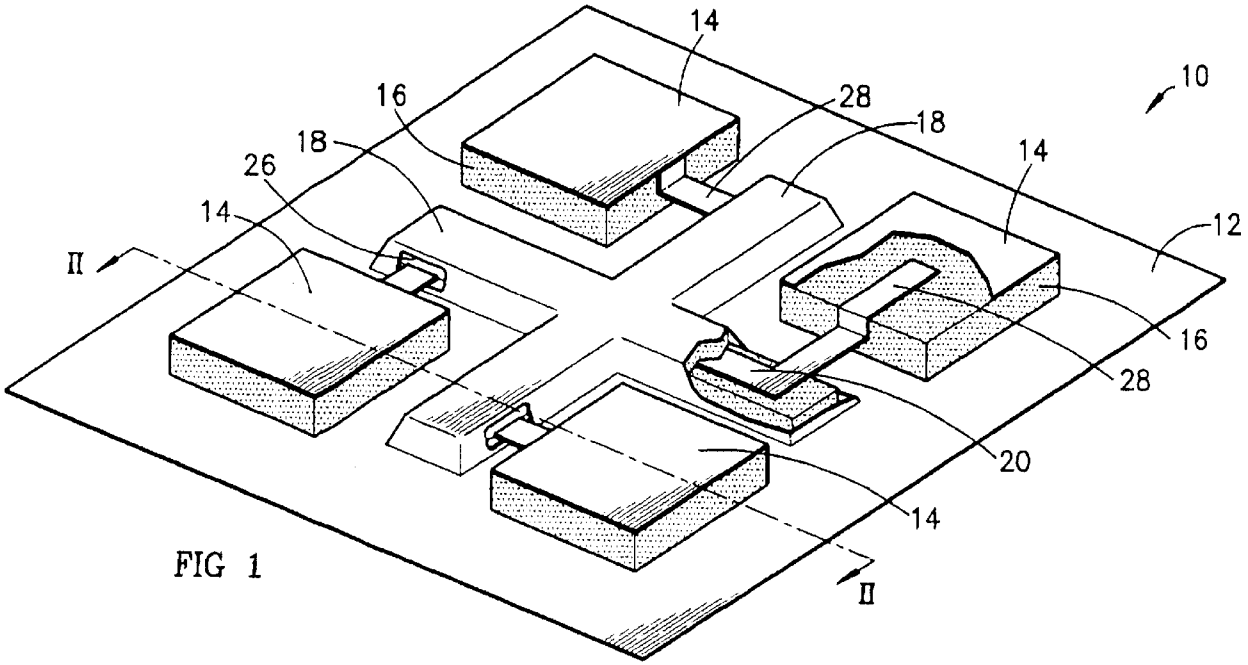
FIG. 1 is an oblique view of a planar or flat panel array antenna in accordance with the invention, parts thereof being shown cut-away to reveal the underlying structure.
Figure 2:
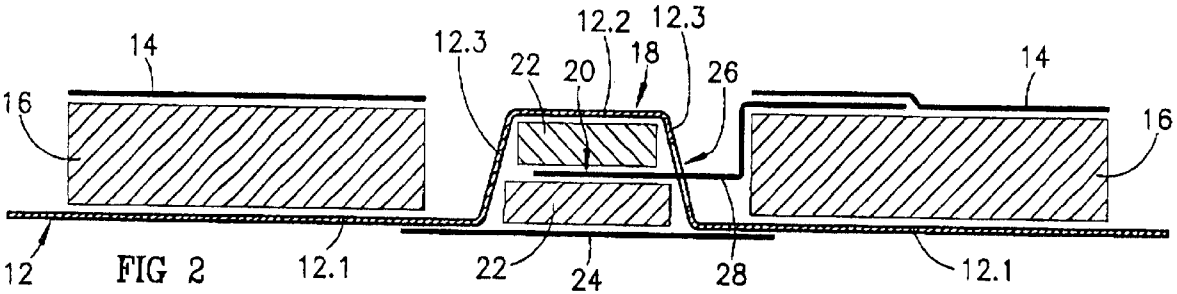
FIG. 2 is a diagrammatic section on II—II in FIG. 1.

Referring now to the drawings in more detail, reference numeral 10 generally indicates a flat panel array antenna which comprises a metal sheet 12 forming a ground plane, and a rectangular array of radiator elements in the form of patches 14 on the ground plane, each patch being separated from the ground plane by a spacer element 16 of dielectric material. Whilst patches which are of the single-layer type are shown in the drawings, the patches can also be of the multi-layer or stacked patch type. The antenna will normally be enclosed between two flat radome shells which are not shown in the drawings.

The metal sheet 12 is of aluminium and has raised portions 18 which extend along, and into the spaces between adjacent spacer elements 16. This forms corresponding channels on the underside of the metal sheet. The metal sheet thus has first portions 12.1 which are at a low level, a second portion 12.2 which is at a high level, and intermediate portions 12.3 which join the second portion to the first portions. The channels are used to accommodate a stripline feed circuit 20 which is located in the channel between a pair of spacer strips 22 of dielectric material, the stripline feed thus being at a level which is between the level of the upwardly facing surfaces of the first portions 12.1 and the level of the downwardly facing surface of the second portion 12.2. The spacer strips 22 are cut to fit snugly in the channels. The second portion 12.2 forms the upper ground plane of the stripline circuit. The lower ground plane of the stripline circuit is formed by a strip of aluminium foil 24 which extends across the channel and whose opposite edge portions overlie and are adhesively secured to the underside of the first portions 12.1.

In the region of each of the patches 14 the intermediate portion 12.3 has an opening 26 therein, the stripline circuit including extensions 28 which pass through these openings and are coupled to the patches 14. In the example illustrated, the extensions 28 are coupled to the patches 14 by the patches overlying the ends of the extensions 28, thereby forming an overlap coupling.

The stripline feed circuit 20 is preferably made of die-cut flexible foil which can be shaped so that different parts thereof can lie at different levels as my be required.

The spacer elements 16 are preferably of an extruded plastics material having a cellular configuration in cross-section, and more particularly the kind that comprises a pair of spaced, parallel skins and webs extending between and separating the skins. Such material is also referred to generically as "corrugated plastic" because of its resemblance to corrugated cardboard. It is commonly used in the packaging and signage industries, and provides a flat surface which is particularly suitable for the application of adhesives or other laminating substances or materials. It is a low cost, mass produced, commercial product, which is available in various discrete thicknesses, with good manufacturing tolerances. The material can be die-cut with sufficient accuracy to enable repeatable high volume assembly. One such type of material is available commercially in South Africa as "Coruplas", which is an extruded polypropylene material. The spacer strips 22 may likewise be of corrugated plastic.

The antenna 10 will include a suitable connector (not shown) for connecting the feed circuit 20 to an external feed.

The metal sheet 12 is preferably of an un-annealed aluminium to provide it with a relatively high degree of stiffness in comparison with annealed aluminium. This allows for easier handling during assembly. It may have a thickness of approximately 0.15 mm and the raised portions 18 may conveniently be formed therein by means of pressing, in a deep drawing tool.

What is claimed is:

1. An array antenna which comprises:

an array of radiator elements;

a stripline feed for the radiator elements;

a metal component which includes a first portion having an upwardly facing surface at a first level, and a second portion having a downwardly facing surface at a second level, the radiator elements being above the first portion, the second level being higher than the first level, and the stripline feed being at a third level between the first and second levels;

the metal component being in the form of a metal sheet which is shaped to form said first portion, said second portion, and an intermediate portion which extends from the first portion to the second portion;

the intermediate portion having, in respect to each of the radiator elements, an opening therein; and the stripline feed having, in respect to each of the radiator element, an extension which passes through the respective opening to the respective radiator element.

2. An antenna according to claim 1, wherein the metal sheet is of an un-annealed aluminium.

3. An antenna according to claim 2, wherein the metal sheet is formed by pressing, in a deep drawing tool.

4. An antenna according to claim 1, wherein said second portion is between a pair of said radiator elements, and wherein there is said first portion and said intermediate portion on each opposite side of the second portion, thereby to form a channel in the underside of the metal sheet, the stripline feed being in the channel.

5. An antenna according to claim 4, which further comprises a sheet of conductive foil which extends across the channel on the underside of the metal sheet, said second portion forming an upper ground plane for the stripline feed and said sheet of conductive foil forming a lower ground plane for the stripline feed.

6. An antenna according to claim 5, wherein said sheet of conductive foil has opposite edge portions which overlie and are adhesively secured to the underside of the respective first portions.

7. An antenna according to claim 1, wherein each radiator element is separated from said first portion by a spacer element which is of an extruded plastics material having a cellular configuration in cross-section.

8. An antenna according to claim 1, wherein the stripline feed is held between spacer strips which are of an extruded plastics material having a cellular configuration in cross-section.

9. An array antenna which comprises:

a metal sheet having an upper side and a lower side;

an array of radiator elements on the upper side of the metal sheet, each radiator element being separated from the metal sheet by a spacer element of dielectric material;

a stripline feed for the radiator elements, the stripline feed being on the lower side of the metal sheet;

the metal sheet being shaped to have a first portion which is at a low level, a second portion which is at a high level, and an intermediate portion which extends from the first portion to the second portion;

the arrangement of the radiator elements and the stripline feed in relation to the metal sheet being such that said first portion forms a ground plane for the radiator elements, and said second portion forms an upper ground plane for the stripline feed;

the intermediate portion having, in respect to each of the radiator elements, an opening therein; and the stripline feed having, in respect of each of the radiator elements, an extension which passes through the respective opening to the respective radiator element.

10. An array antenna which comprises:

an array of radiator elements;

a stripline feed for the radiator elements;

a metal component which includes a first portion having an upwardly facing surface at a first level, and a second portion having a downwardly facing surface at a second level, the radiator elements being above the first portion, the second level being higher than the first level, and the stripline feed being at a third level between the first and second levels;

the metal component being in the form of a metal sheet which is shaped to form said first portion, said second portion, and an intermediate portion which extends from the first portion to the second portion;

said second portion being between a pair of said radiator elements; there being a said first portion and a said intermediate portion on each opposite side of the second portion, thereby to form a channel in the underside of the metal sheet, the stripline feed being in the channel; and there being a sheet of conductive foil which extends across the channel on the underside of the metal sheet, said second portion forming an upper ground plane for the stripline feed and said sheet of conductive foil forming a lower ground plane for the stripline feed.

11. An antenna according to claim 10, wherein said sheet of conductive foil has opposite edge portions which overlie and are adhesively secured to the underside of the respective first portions.

12. An array antenna which comprises:

an array of radiator elements;

a stripline feed for the radiator elements;

a metal component which includes a first portion having an upwardly facing surface at a first level, a second portion having a downwardly facing surface at a second level, and an intermediate portion which extends from the first portion to the second portion, the radiator elements being above the first portion, the second level being higher than the first level, and the stripline feed being underneath the second portion;

the intermediate portion having, in respect to each of the radiator elements, an opening therein; and the stripline feed having, in respect to each of the radiator elements, an extension which passes through the respective opening to the respective radiator element.

* * * * *